US009923267B1

(12) United States Patent
Pala et al.

(10) Patent No.: US 9,923,267 B1
(45) Date of Patent: Mar. 20, 2018

(54) PHASE-CHANGE MATERIAL BASED RECONFIGURABLE ANTENNA

(71) Applicants: Nezih Pala, Fort Lauderdale, FL (US); Burak Gerislioglu, Miami, FL (US); Arash Ahmadivand, Miami, FL (US); Mustafa Karabiyik, Miami, FL (US)

(72) Inventors: Nezih Pala, Fort Lauderdale, FL (US); Burak Gerislioglu, Miami, FL (US); Arash Ahmadivand, Miami, FL (US); Mustafa Karabiyik, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 15/653,804

(22) Filed: Jul. 19, 2017

(51) Int. Cl.
*H01Q 3/01* (2006.01)
*H01Q 9/04* (2006.01)

(52) U.S. Cl.
CPC ..... *H01Q 3/01* (2013.01); *H01Q 9/0407* (2013.01)

(58) Field of Classification Search
CPC ..... H01Q 3/01
See application file for complete search history.

(56) References Cited

U.S. PATENT DOCUMENTS 6,567,046 B2 5/2003 Taylor et al.
6,885,345 B2 4/2005 Jackson
7,403,172 B2 7/2008 Cheng
2008/0198074 A1 8/2008 Walton et al.
2015/0295309 A1 10/2015 Manry, Jr. et al.
2016/0013549 A1* 1/2016 Schaffner ..... H01Q 21/065 343/724

OTHER PUBLICATIONS

D. E. Anagnostou et al., "Integration of resistive heaters for phase-change reconfigurable antennas," 2017 11th European Conference on Antennas and Propagation (EUCAP), Paris, Mar. 19-24, 2017, pp. 2349-2350.*
Ting-Ting Wu et al., "Electrical properties of micro-heaters using sputtered NiCr thin film," The 8th Annual IEEE International Conference on Nano/Micro Engineered and Molecular Systems, Suzhou, 2013, pp. 466-469.*
D. E. Anagnostou, T. S. Teeslink, D. Torres and N. Sepúlveda, "Vanadium dioxide reconfigurable slot antenna," 2016 IEEE International Symposium on Antennas and Propagation (APSURSI), Fajardo, 2016, pp. 1055-1056.*
(Continued)

*Primary Examiner* — Jessica Han
*Assistant Examiner* — Amal Patel
(74) *Attorney, Agent, or Firm* — Saliwanchik, Lloyd & Eisenschenk

(57) ABSTRACT

Apparatuses and methods for making configurable antennas are provided. An apparatus can include a phase change material (PCM) having a conductive phase and an insulating phase. The PCM can be activated to the conductive phase to produce an antenna structure. Different antenna shapes can be created by selectively inducing regions in the PCM to be conductive. Different antenna shapes can be produced having specific resonance frequencies and radiation patterns to suit the application. The PCM phase change can be induced using selective heat application.

19 Claims, 7 Drawing Sheets

(56) References Cited

OTHER PUBLICATIONS

Huitema et al., "Highly integrated VO_2-based antenna for frequency tunability at millimeter-wave frequencies," 2016 International Workshop on Antenna Technology, Feb. 2016, pp. 40-43.
El-Hinnawy et al., "A four-terminal, inline, chalcogenide phase-change RF switch using an independent resistive heater for thermal actuation," IEEE Electron Device Letters, Oct. 2013, pp. 1313-1315, vol. 34, No. 10.
Morin, "Oxides which show a metal-to-insulator transition at the neel temperature," Physical Review Letters, Jul. 1959, pp. 34-36, vol. 3, No. 1.
Dai et al., "Modeling of temperature-dependent resistance in micro- and nanopolycrystalline VO_2 thin films with random resistor networks," Optical Engineering, Mar. 2008, pp. 033801-1-033801-4, vol. 47, No. 3.
Zylbersztejn et al., "Metal-insulator transition in vanadium dioxide," Physical Review B, Jun. 1975, pp. 4383-4395, vol. 11, No. 11.
Strelcov et al., "Gas sensor based on metal-insulator transition in VO_2 nanowire thermistor," Nano Letters, May 2009, pp. 2322-2326, vol. 9, No. 6.
Qazilbash et al., "Mott transition in VO_2 revealed by infrared spectroscopy and nano-imaging," Science, Dec. 2007, pp. 1750-1753, vol. 318.
Calatayud et al., "A theoretical study on the structure, energetics and bonding of VO_x+ and VO_x (x=1-4) systems," Chemical Physics Letters, Jan. 2001, pp. 493-503, vol. 333.
Wentzcovitch et al., "VO_2: peierls or mott-hubbard? A view from band theory," Physical Review Letters, May 1994, pp. 3389-3392, vol. 72, No. 21.
Bernhard et al., "Stacked reconfigurable antenna elements for space-based radar applications," IEEE Antennas and Propagation Society International Symposium, Jul. 2001, pp. 158-161.
Pfeiffer et al., "A 0.53 THz reconfigurable source module with up to 1 mW radiated power for diffuse illumination in terahertz imaging applications," IEEE Journal of Solid-State Circuits, Dec. 2014, pp. 2938-2950, vol. 49, No. 12.
Lugo et al., "Six-state reconfigurable filter structure for antenna based systems," IEEE Transactions on Antennas and Propagation, Feb. 2006, pp. 479-483, vol. 54, No. 2.
Cetiner et al., "Multifunctional reconfigurable MEMS integrated antennas for adaptive MIMO systems," IEEE communications Magazine, Dec. 2004, pp. 62-70.
Raoux et al., "Crystallization times of Ge-Te phase change materials as a function of composition," Applied Physics Letters, Aug. 2009, pp. 1-3, vol. 95, No. 071910.
Federal Communications Commission, First Report and Order, Apr. 2002, pp. 1-118, FCC 02-48.
Nikolaou et al., "Design and development of a compact UWB monopole antenna with easily-controllable return loss," IEEE Transactions on Antennas and Propagation, Apr. 2017, pp. 2063-2067, vol. 65, No. 4.
Wang et al., "A novel coplanar waveguide feed zeroth-order resonant antenna with resonant ring," IEEE Antennas and Wireless Propagation Letters, Apr. 2014, pp. 774-777, vol. 13.
Chen et al., "Dual-band dual-sense circularly-polarized CPW-fed slot antenna with two spiral slots loaded," IEEE Transactions on Antennas and Propagation, Jun. 2009, pp. 1829-1833, vol. 57, No. 6.
Wang et al., "Studies of the novel CPW-fed spiral slot antenna," IEEE Antennas and Wireless Propagation Letters, 2004, pp. 186-188, vol. 3.
Chen et al., "A CPW-fed dual-frequency monopole antenna," IEEE Transactions on Antennas and Propagation, Apr. 2004, pp. 978-982, vol. 52, No. 4.
Liu et al., "Novel CPW-Fed planar monopole antenna for WiMAX/WLAN applications," IEEE Antennas and Wireless Propagation Letters, Mar. 2010, pp. 240-243, vol. 9.
Auerkari, "Mechanical and physical properties of engineering alumina ceramics," Technical Research Centre of Finland ESPOO, 1996, pp. 1-26.
Burgemeister et al., "Thermal conductivity and electrical properties of 6H silicon carbide," Journal of Applied Physics, Sep. 1979, pp. 5790-5794, vol. 50, No. 9.
Oh et al., "Thermal conductivity and dynamic heat capacity across the metal-insulator transition in thin film VO_2," Applied Physics Letters, Apr. 2010, pp. 151906-1-151906-3, vol. 96.
Freeman et al., "Characterization and modeling of metal-insulator transition (MIT) based tunnel junctions," 70th Annual Device Research Conference, Jun. 2012, pp. 243-244.
Young et al., "Thermal analysis of an indirectly heat pulsed non-volatile phase change material microwave switch," Journal of Applied Physics, Aug. 2014, pp. 054504-1-054504-6, vol. 116.
Farrell et al., "The electrical resistivity of nickel and its alloys," Journal of Physics C: Solid State Physics, 1968, pp. 1359-1369, vol. 1, No. 2.
Kiiko et al., "Thermal conductivity and prospects for application of beo ceramic in electronics," Glass and Ceramics, Mar. 2015, pp. 387-391, vol. 71, Nos. 11-12.
Kelley, "Contributions to the data on theoretical metallurgy XIII: High-temperature heat-content, heat-capacity, and entropy data for the elements and inorganic compounds," Bulletin 584: Bureau of Mines, 1960, pp. 1-232.
Zaker et al., "A very compact ultrawideband printed omnidirectional monopole antenna," IEEE Antennas and Wireless Propagation Letters, May 2010, pp. 471-473, vol. 9.
Zaker et al., "Novel modified UWB planar monopole antenna with variable frequency band-notch function," IEEE Antennas and Wireless Propagation Letters, May 2008, pp. 112-114, vol. 7.
Wang et al., "An x-band reconfigurable bandpass filter using phase change RF switches," IEEE 16th Topical Meeting on Silicon Monolithic Integrated Circuits in RF Systems, Jan. 2016, pp. 1-4.
Teeslink et al., "Reconfigurable bowtie antenna using metal-insulator transition in vanadium dioxide," IEEE Antennas and Wireless Propagation Letters, Feb. 2015, pp. 1381-1384, vol. 14.
Ha et al., "Quick Switch," IEEE Microwave Magazine, Sep./Oct. 2014, pp. 32-44.
Shim et al., "RF switches using phase change materials," IEEE 26th International Conference on Micro Electro Mechanical Systems, Jan. 2013, pp. 237-240.
Dumas-Bouchiat et al., "Re-microwave switches based on reversible semiconductor-metal transition of VO2 thin films synthesized by pulsed-laser deposition," Applied Physics Letters, Nov. 2007, pp. 223505-1-223505-3, vol. 91, No. 22.
Stefanovich et al., "Electrical switching and mott transition in VO2," Journal of Physics: Condensed Matter, Jul. 2000, pp. 8837-8845, vol. 12.
Eyert, "The metal-insulator transitions of VO2: a band theoretical approach," Annals of Physics, Oct. 2002, pp. 1-61, vol. 11.
Kim et al., "Mechanism and observation of mott transition in VO2-based two-and three-terminal devices," New Journal of Physics, May 2004, pp. 1-19, vol. 6, No. 52.
Cavalleri et al., "Femtosecond structural dynamics in VO2 during an ultrafast solid-solid phase transition," Physical Review Letters, Jan. 2002, pp. 1-4.
Coy et al., "Optoelectronic and all-optical multiple memory states in vanadium dioxide," Journal of Applied Physics, Dec. 2010, pp. 113115-1-113115-6, vol. 108, No. 11.
Merced et al., "Photothermal actuation of VO2: Cr-coated microcantilevers in air and aqueous media," Smart Materials and Structures, Aug. 2012, pp. 1-9, vol. 21.
Bakan et al., "Extracting the temperature distribution on a phase-change memory cell during crystallization," Journal of Applied Physics, Oct. 2016, pp. 164504-1-164504-6, vol. 120, No. 16.
Cabrera et al., "Performance of electro-thermally driven VO2-based mems actuators," Journal of Microelectromechanical Systems, Feb. 2014, pp. 243-251, vol. 23, No. 1.
Jepsen et al., "Metal-insulator phase transition in a VO2 thin film observed with terahertz spectroscopy," Physical Review B, Nov. 2006, pp. 205103-1-205103-9, vol. 74, No. 20.

(56) References Cited

OTHER PUBLICATIONS

Ordonez-Miranda et al., "Dynamical heat transport amplification in a far-field thermal transistor of VO2 excited with a laser of modulated intensity," Journal of Applied Physics, May 2016, pp. 203105-1-203105-7, vol. 119.
Ahmadivand et al., "Optical switching using transition from dipolar to charge transfer plasmon modes in Ge2Sb2Te5 bridged metal-lodielectric dimers," Scientific Reports, Feb. 2017, pp. 1-8, vol. 7.
Seo et al., "Active terahertz nanoantennas based on VO2 phase transition," Nano Letters, May 2010, pp. 2064-2068, vol. 10.
Jusoh et al., "Reconfigurable four-parasitic-elements patch antenna for high-gain beam switching application," IEEE Antennas and Wireless Propagation Letters, Jan. 2014, pp. 79-82, vol. 13.
Anagnostou et al., "A coplanar reconfigurable folded slot antenna without bias network for WLAN applications," IEEE Antennas and Wireless Propagation Letters, Sep. 2009, pp. 1057-1060, vol. 8.
Peroulis et al., "Design of reconfigurable slot antennas," IEEE Transactions on Antennas and Propagation, Feb. 2005, pp. 645-654, vol. 53, No. 2.
Romano et al., "Design of a reconfigurable antenna for ground penetrating radar applications," Progress in Electromagnetics Research, 2009, pp. 1-18, vol. 94.
Abutarboush et al., "A reconfigurable wideband and multiband antenna using dual-patch elements for compact wireless devices," IEEE Transactions on Antennas and Propagation, Jan. 2012, pp. 36-43, vol. 60, No. 1.
Nikolaou et al., "Pattern and frequency reconfigurable annular slot antenna using pin diodes," IEEE Transactions on Antennas and Propagation, Feb. 2006, pp. 439-448, vol. 54, No. 2.
Behdad et al., "Dual-band reconfigurable antenna with a very wide tunability range," IEEE Transactions on Antennas and Propagation, Feb. 2006, pp. 409-416, vol. 54, No. 2.
Anagnostou et al., "Reconfigurable uwb antenna with rf-mems for on-demand wlan rejection," IEEE Transactions on Antennas and Propagation, Feb. 2014, pp. 1-7.
Sebastian et al., "Crystal growth within a phase change memory cell," Nature Communications, Jul. 2014, pp. 1-9, vol. 5, No. 4314.
Dirisaglik et al., "High speed, high temperature electrical characterization of phase change materials: metastable phases, crystallization dynamics, and resistance drift," Nanoscale, Jan. 2015, pp. 1-5.
Shportko et al., "Resonant bonding in crystalline phase-change materials," Nature Materials, Aug. 2008, pp. 653-658, vol. 7.
Faraclas et al., "Modeling of thermoelectric effects in phase change memory cells," IEEE Transactions on Electron Devices, Feb. 2014, pp. 372-378, vol. 61, No. 2.
Yamada et al., "Rapid-phase transitions of GeTe—Sb2 Te3 pseudobinary amorphous thin films for an optical disk memory," Journal of Applied Physics, Mar. 1991, pp. 2849-2856, vol. 69, No. 5.
Mashaal et al., "A coplanar waveguide fed two arm archimedean spiral slot antenna with improved bandwidth," IEEE Transactions on Antennas and Propagation, Feb. 2013, pp. 939-943, vol. 61, No. 2.
Weller et al., "Single and double folded-slot antennas on semi-infinite substrates," IEEE Transactions on Antennas and Propagation, Dec. 1995, pp. 1423-1428, vol. 43, No. 12.
Hitova et al., "Heat capacity of 4H—SiC determined by differential scanning calorimetry," Journal of Electrochemical Society, 2000, pp. 3546-3547, vol. 147, No. 9.
Siddiqui et al., "Compact SRR loaded UWB circular monopole antenna with frequency notch characteristics," IEEE Transactions on Antennas and Propagation, Aug. 2014, pp. 4015-4020, vol. 62, No. 8.
Siddiqui et al., "Compact dual-SRR-loaded UWB monopole antenna with dual frequency and wideband notch characteristics," IEEE Antennas and Wireless Propagation Letters, 2015, pp. 100-103, vol. 14.
Azim et al., "Planar UWB antenna with multi-slotted ground plane," Microwave and Optical Technology Letters, May 2011, pp. 966-968, vol. 53, No. 5.

* cited by examiner

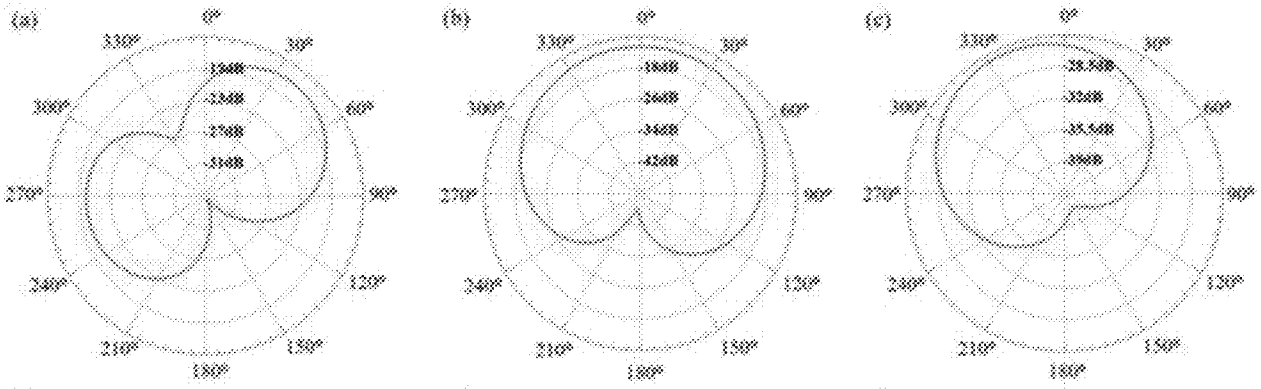
FIGURE 6(a)
FIGURE 6(b)
FIGURE 6(c)
FIGURE 6(d)
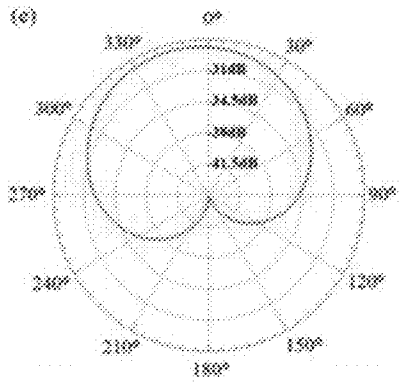
FIGURE 6(e)
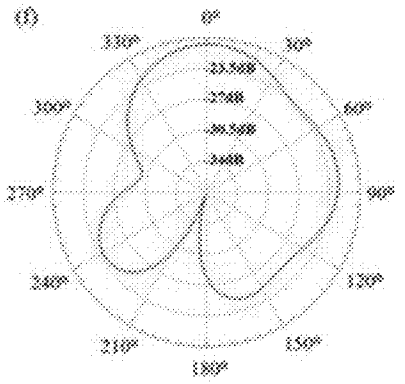
FIGURE 6(f)

PHASE-CHANGE MATERIAL BASED RECONFIGURABLE ANTENNA

GOVERNMENT SUPPORT

This invention was made with government support under Grant No. W911NF-12-2-0023 awarded by the Army Research Laboratory (ARL) Multiscale Multidisciplinary Modeling of Electronic Materials (MSME) Collaborative Research Alliance (CRA). The government has certain rights in the invention.

BACKGROUND

Reconfigurable antennas with wideband tunability of radiation pattern, frequency, and polarization are in high demand as modern devices need to be flexible enough to operate under a variety of circumstances using multiple data transfer technologies. Therefore, there is a current need in the art for antennas that can effectively deliver these characteristics in appropriate form factors.

BRIEF SUMMARY

Embodiments of the present invention include apparatuses and methods for making reconfigurable antennas. Embodiments of the present invention can use a phase change material (PCM) having a conductive phase and an insulating phase. The PCM can be activated to the conductive phase to produce an antenna structure. Different antenna shapes can be created by selectively inducing regions in the PCM to be conductive. Different antenna shapes can be produced having specific resonance frequencies and radiation patterns. The phase transition process of PCM can be induced using selective heat application.

In an embodiment, a reconfigurable antenna platform can include a phase change material (PCM) layer that is insulating in a first phase and conductive in a second phase, and a shape-controllable heating layer beneath the PCM layer. The PCM phase transition can be referred to as an insulator to metal transition or vice versa. The shape-controllable heating layer can include a matrix of heating elements, which has individual micro-heaters formed in a grid.

A barrier layer can be formed between the shape-controllable heating layer and the PCM layer and an insulating layer can be deposited beneath the shape-controllable heating layer. An electrode layer can be included beneath an insulating layer. The electrode layer can be connected to the heating layer through vias in the insulating layer. The antenna platform can be formed on a substrate, which can be sapphire, silicon, or other materials. One or more insulating layers can be included directly on the substrate. A protective layer can be deposited on the PCM layer In an embodiment of the present invention, a vanadium dioxide ($VO_2$) based reconfigurable antenna platform with individually-controlled microheater elements can be included. An indirect excitation mechanism can be used to change the electrical resistivity of the vanadium dioxide by transferring heat generated within the heating elements to the vanadium dioxide layer. In this scheme, electrical stimuli are only applied to the microheaters, not directly to the PCM. By taking the advantage of this technique, planar antennas on a microheater matrix can be configured into different patterns having operating frequencies in the S-band (2-4 GHz), C-band (4-8 GHz) and X-band (8-12 GHz), which covers the entire Ultra-Wideband (UWB) spectrum (3.1 to 10.6 GHz).

Embodiments of the present invention can have advantages over the prior art including a simple fabrication process, greater bandwidth, better bandwidth control, noise elimination, easier integration to monolithic microwave integrated circuits (MMIC), and better dispersion characteristics relative to microstrip-fed antennas.

BRIEF DESCRIPTION OF THE DRAWINGS

FIG. 1(*b*) is a magnified view of one microheater element with a serpentine heater regions; FIG. 1(*c*) is a cross-sectional view of an antenna platform according to the present invention; and FIG. 1(*d*) is an equivalent circuit model for a control matrix consisting of 9×9 microheaters.

FIG. 3(*b*) is a temperature plot at the top surface of a $VO_2$ layer between three neighboring elements; FIG. 3(*c*) is a graph of time-dependent temperatures at a Ni—Cr heater and between two neighboring elements on the $VO_2$ layer for a cooling cycle; and FIG. 3(*d*) is a temperature map across the antenna structure in the ON (i.e., conductive or metallic) state of $VO_2$.

FIGS. 6(*a*), 6(*b*), 6(*c*), 6(*d*), 6(*e*), and 6(*f*) are simulated radiation patterns in the xz-plane at 7.4, 5.2, 2.8, 2, 2.7, and 10 GHz, respectively.

DETAILED DESCRIPTION

Figure 1A:
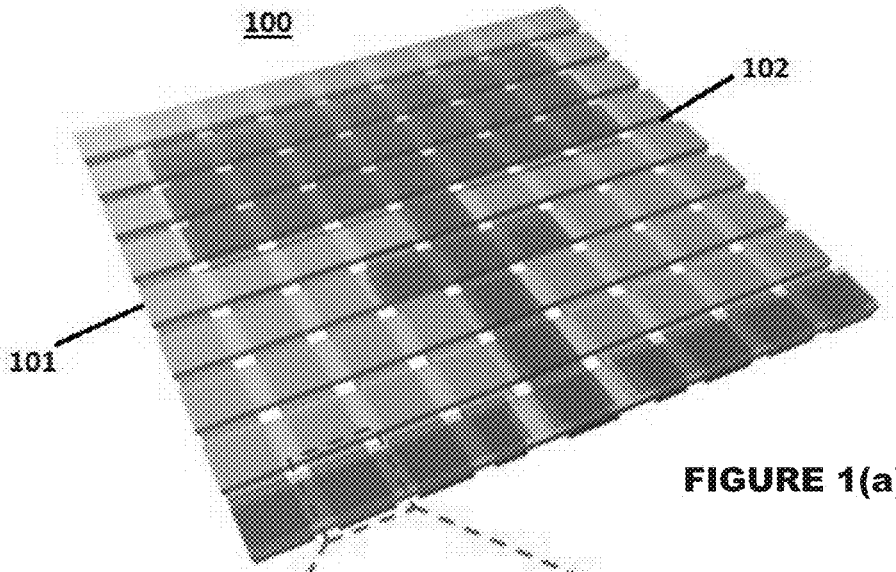
FIG. 1(*a*) is a diagram of a reconfigurable antenna according to an embodiment of the present invention.
Figure 1B:
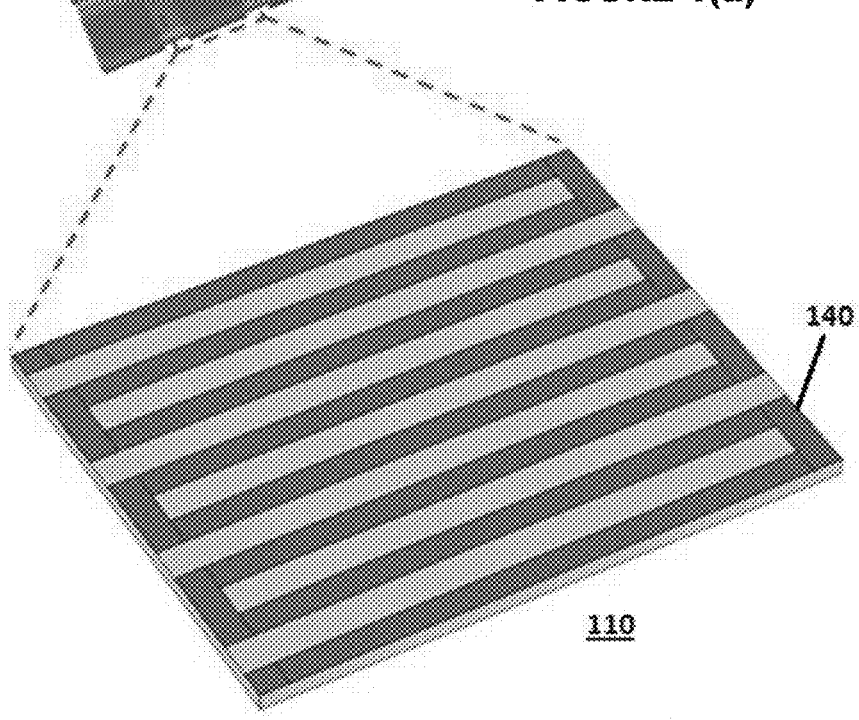
Figure 1C:
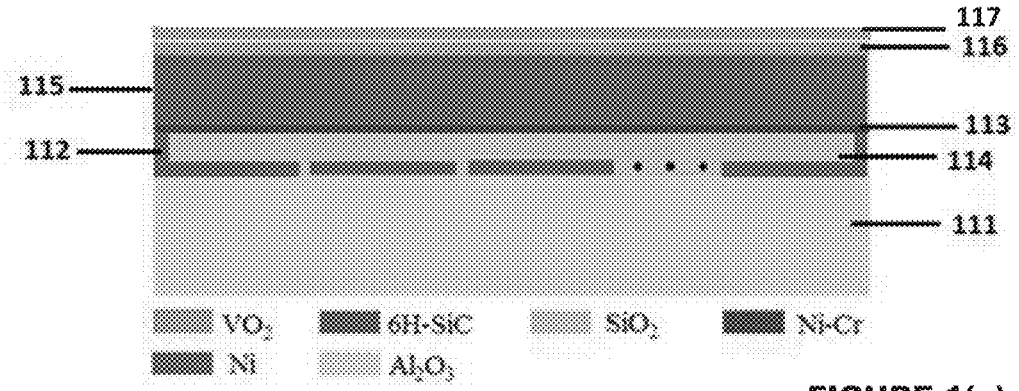
Figure 1D:
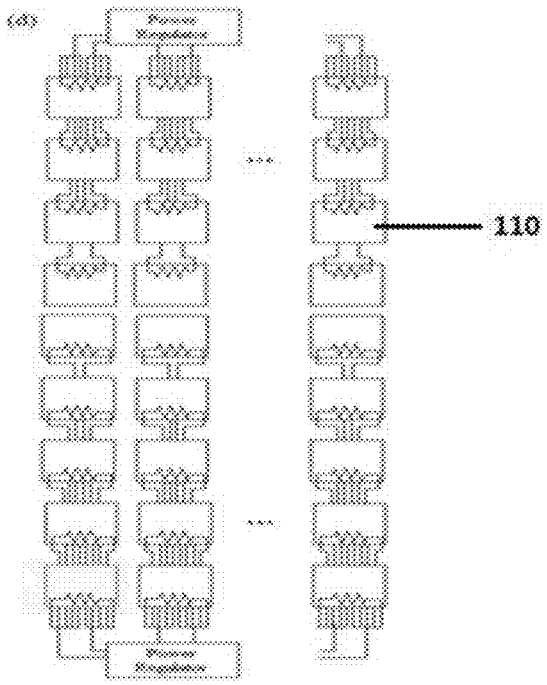

Embodiments of the present invention include apparatuses and methods for making configurable antennas. Embodiments of the present invention can use a phase change material (PCM) having a conductive phase and an insulating phase. The PCM can be activated to the conductive phase to produce an antenna structure. Different antenna shapes can be created by selectively inducing regions in the PCM to be conductive. Antenna shapes having various geometries can be produced with specific resonance frequencies and radiation patterns. The phase transition of PCM can be induced by selectively heating specific regions of the PCM.

Many broadband telecommunication systems require compact, low radiation loss and wideband antenna structures. Ultra-Wideband (UWB) applications have specifically attracted attention due to their potential use in low-energy, high-bandwidth communications. However, requirements for antenna design strongly depend on the intended application. For wireless applications, especially for mobile handheld devices, small omni-directional antenna patterns are in demand. Embodiments of the present invention have the ability to effectively fill this and other deficiencies of the prior art.

Vanadium dioxide ($VO_2$) is a phase change material (PCM) (also referred as metal-to-insulator transition (MIT)

material) that behaves as an insulator at room temperature, but undergoes a phase transition to a metallic state when heated above ~343 K due to reorganization of its molecular structure. In such phase transitions (switching), its electrical resistivity can be varied from 0.1 Ω·m to $3\times10^{-6}$ Ω·m, in a few nanoseconds by using direct electrical stimulation, conductive heating, photo-thermal heating, Joule heating, and ultra-fast optical stimuli. Drastic changes in its resistivity and permittivity based on solid-to-solid phase transition allows $VO_2$ to be used as a PCM in embodiments of the present invention. Other examples of PCM that can be applied to embodiments of the present invention include germanium antimony telluride ($Ge_xSb_yTe_z$) and/or germanium telluride.

A reconfigurable antenna platform 100 according to an embodiment of the present invention is shown in FIG. 1. A shape-controllable heating layer can be formed using a microheater matrix. FIG. 1 shows a matrix of 9×9 microheater elements 101, but more or less elements can be included to adjust the resolution of the antenna platform. A gap 102 can be formed between each of the microheater elements. In FIG. 1(*a*), the phase change material (PCM) layer is rendered semi-transparent to show the proposed antenna structure clearly. The details of one embodiment of a single microheater element 110 are shown in FIG. 1(*b*).

FIG. 1(*c*) shows a cross-sectional view of an antenna platform of an embodiment of the present invention. The antenna platform is shown having specifically defined material construction, but this is for example only and other equivalent materials can be substituted. Referring to FIG. 1(*c*), the antenna platform is built on a sapphire ($Al_2O_3$) substrate 111. The antenna has nickel (Ni) electrodes 112 that serve as the ground and DC bias contacts to a nichrome (Ni—Cr) resistive heater 113. The nichrome (Ni—Cr) resistive heater 113 is located on a silicon dioxide ($SiO_2$) insulating layer 114. The insulating layer 114 provides electrical insulation between the neighboring layers and electrodes 112. The electrodes 112 of each element can be seen connected to the heating layer 113 through via like structures. Next, a silicon carbide (6H—SiC) barrier layer 115 can be inserted between the shape-controllable heating layer 113 and the top phase-change material (PCM) layer 116. The entire structure can be covered by a protective layer 117. The antenna platforms of the embodiments of present invention can be fabricated using nanofabrication tools and techniques including electron beam evaporation, sputtering, photolithography patterning, RF-sputtering, reactive-ion etching (RIE), pulsed-laser deposition (PLD), eutectic bonding and flip chip bonding.

The antenna platforms can operate by generating and transferring heat to transition the PCM between OFF (insulating) and ON (conductive) states. The antenna geometries and working specifications can be adjusted depending on which heating elements (or microheaters) are activated. Applying an electric potential to the electrodes of each element produces heat, which is transferred through the barrier layer 115 to the PCM layer. A biasing network can be formed in the electrode layer 112 to selectively activate the microheater (or heating element) array of the shape-controllable heating layer 113. This allows different antenna shapes to be formed by heating specific areas of the PCM layer. FIG. 1(*b*) shows a magnified view of one microheater 101 having a serpentine shaped heating element 140, as an example.

Figure 2:
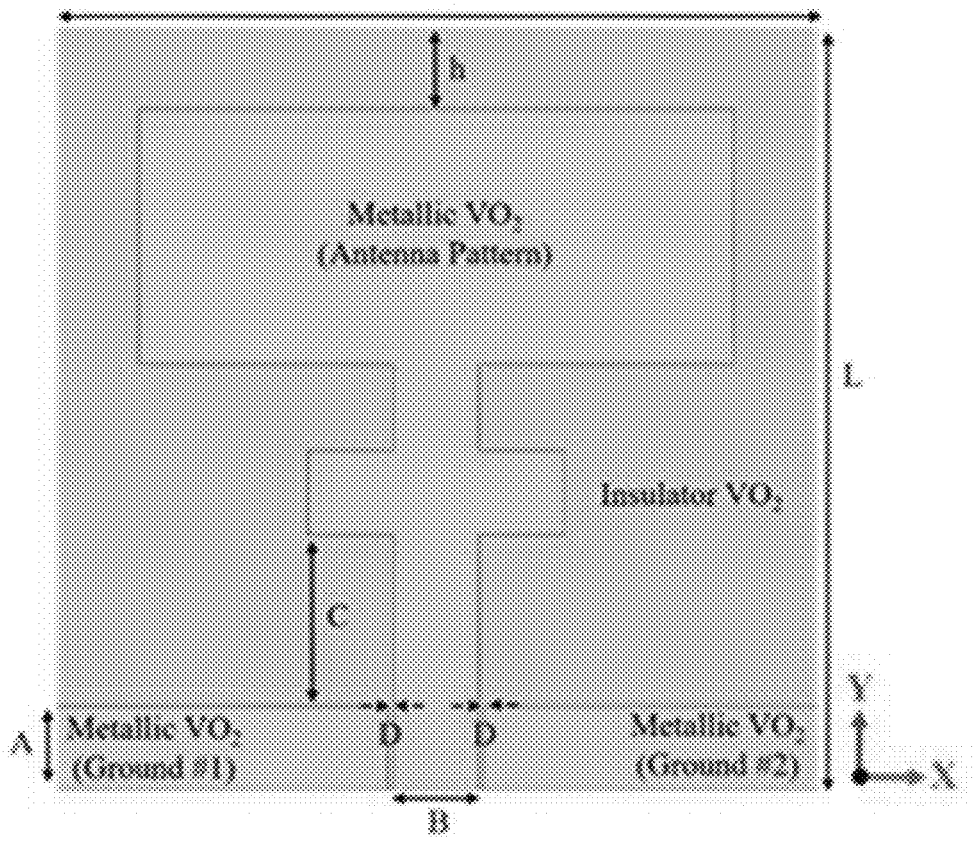
FIG. 2 is a top-view plot of one realizable coplanar waveguide (CPW)-fed planar monopole antenna pattern according to an embodiment of the present invention.

Capacitive coupling can be realized between the feed line and each one of the ground planes using spacings (D), as shown in FIG. 2. These spacings D can be attained by slightly modifying the microheater elements, at the edges of the ground planes. The spacings D are the spacings between the radiator and ground planes of the antenna at the feed line. In some embodiments, the entire top active layer (all sections seen in FIG. 2) can be $VO_2$ (see also FIG. 1(*c*)). Selected parts of the $VO_2$ layer can be converted to a metallic phase (shown yellow (or lighter shaded) in FIG. 2) by applying heat while the other parts remain dielectric (shown blue (or darker shaded) in FIG. 2). Hence, the width and the exact position of the spacings D can be adjusted for the desired antenna characteristics.

FIG. 2 shows a top-view of one antenna pattern that can be produced. This antenna design can be characterized as a T-shaped antenna pattern, having a coplanar feed line and two ground planes. The barrier layer 115, in addition to serving as a heat bridge with high thermal conductivity, can electrically isolate the antenna pattern induced in the PCM 116 from the metallic components of the underlying microheater matrix configuration to prevent destructive effects such as shorting.

Antenna platforms of the embodiments of present invention can be configured to form antenna structures of any shape. FIG. 4 shows a variety of antenna structures that can be formed using antenna platforms of embodiments of the present invention. The antenna structures shown in FIGS. 4(*a*) and 4(*b*) are optimized for the C-band spectrum. The antenna patterns in FIGS. 4(*c*), 4(*d*), and 4(*e*) are designed to operate in the S-band spectrum, while the pattern of FIG. 4(*f*) is designed to operate in the X-band. The antenna patterns of FIG. 4 can be referred to as a (a) square pattern, (b) a tuning-fork pattern, (c) a fat double-beam pattern, (d) a thin-double-beam pattern, (e) an irregular triple-beam pattern, and (f) a triple-beam pattern.

The subject invention includes, but is not limited to, the following exemplified embodiments.

Embodiment 1

A reconfigurable antenna platform comprising:

a phase change material (PCM) layer that is insulating in a first phase and conductive in a second phase (or has a switchable metal to insulator transition); and a shape-controllable heating layer beneath the PCM layer.

Embodiment 2

The antenna platform of Embodiment 1, wherein the shape-controllable heating layer includes a matrix of heating elements (e.g., individual micro-heaters and/or elements formed in a grid).

Embodiment 3

The antenna platform of Embodiment 2, wherein the matrix of heating elements is a minimum of six heating elements wide and/or a minimum of six elements long.

Embodiment 4

The antenna platform of any of Embodiments 2 to 3, wherein the matrix of heating elements is a minimum of nine heating elements wide and/or a minimum of nine elements long.

Embodiment 5

The antenna platform of any of Embodiments 1 to 4, wherein each of the heating elements is a nickel-chromium heater.

Embodiment 6

The antenna platform of any of Embodiments 1 to 5, wherein the PCM layer includes vanadium dioxide ($VO_2$).

Embodiment 7

The antenna platform of any of Embodiments 1 to 6, wherein the antenna platform can operate at one, two, three, four, five, or all six of the following frequencies (all values in GHz): 2.0, 2.7, 2.8, 5.2, 7.4, and 10.

Embodiment 8

The antenna platform of any of Embodiments 1 to 7, wherein the antenna platform can operate in a frequency range of 2.0-10 GHz (covering the entire Ultra Wideband (UWB) spectrum).

Embodiment 9

The antenna platform of any of Embodiments 1 to 8, wherein the antenna platform can operate in the S, C, and X-bands.

Embodiment 10

The antenna platform of any of Embodiments 1 to 9, wherein the PCM layer includes germanium antimony telluride ($Ge_xSb_yTe_z$; e.g., $Ge_2Sb_2Te_5$ (GST)) and/or germanium telluride ($Ge_xTe_y$)).

Embodiment 11

The antenna platform of any of Embodiments 1 to 10, further comprising a barrier layer between the shape-controllable heating layer and the PCM layer.

Embodiment 12

The antenna platform of any of Embodiments 1 to 11, further comprising an insulating layer beneath the shape-controllable heating layer.

Embodiment 13

The antenna platform of any of Embodiments 1 to 12, wherein the shape-controllable heating layer includes individual micro-heaters, and wherein one or more (or all) of the micro-heaters includes a serpentine heating element.

Embodiment 14

The antenna platform of any of Embodiments 1 to 13, wherein the shape-controllable heating layer includes individual micro-heaters, and wherein each micro-heater includes a solid (non-serpentine) heating element.

Embodiment 15

The antenna platform of any of Embodiments 1 to 14, wherein the shape-controllable heating layer includes individual micro-heaters, and wherein the antenna platform further comprises spacings around each microheater (capacitive coupling can be realized between the feed line and each one of the ground planes using spacings, which can be attained by slightly modifying the microheater elements, at the edges of the ground planes).

Embodiment 16

The antenna platform of any of Embodiments 1 to 15, wherein the PCM layer is less than 30 μm thick, and/or less than 20 μm thick, and/or from 5 μm thick to 15 μm thick (inclusive).

Embodiment 17

The antenna platform of any of Embodiments 1 to 16, wherein the antenna platform is less than or equal to 2.0 cm in width and/or length.

Embodiment 18

The antenna platform of any of Embodiments 1 to 17, further comprising an electrode layer (the electrode layer can potentially be anywhere, so long as it interfaces with the shape-controllable heating layer; for example, the electrode layer can be beneath an insulating layer and be connected to the heating layer through vias in the insulating layer).

Embodiment 19

The antenna platform of any of Embodiments 1 to 18, further comprising a substrate or base layer (e.g., sapphire) (the base layer can form the base for the electrode layer and/or insulating layer).

Embodiment 20

The antenna platform of any of Embodiments 1 to 19, wherein the antenna platform can form a new antenna structure in an amount of time that is less than or equal to 200 milliseconds (ms), or less than or equal to 100 ms, or less than or equal to 50 ms.

Embodiment 21

The antenna platform of any of Embodiments 1 to 20, wherein the antenna platform can form one, two, three, four, five, or all six of the following antenna patterns: (a) square pattern; (b) a tuning fork pattern; (c) a fat double-beam pattern; (d) a thin double-beam pattern; (e) an irregular triple beam pattern; and (f) and a triple beam pattern.

A greater understanding of the present invention and of its many advantages may be had from the following examples, given by way of illustration. The following examples are illustrative of some of the methods, applications, embodiments and variants of the present invention. They are, of course, not to be considered as limiting the invention. Numerous changes and modifications can be made with respect to the invention.

Example 1

Simulation experiments were conducted to prove the concepts of the present invention. A reconfigurable platform antenna according to the present invention was constructed as shown in FIG. 1. The entire device had dimensions of 18.4×18.4 $mm^2$. The shape-controllable heating layer consisted of 9×9 individual microheater elements 110, each of which was 2×2 mm in size and separated by a gap of 0.05 mm.

The details of the simulated embodiment can be seen in FIG. 1. The entire structure was built on sapphire ($Al_2O_3$) substrate having a thickness of 254 μm. Nickel (Ni) electrodes were used having a thickness of 3 μm and a width of 190 μm, which served as the ground and DC bias contacts to 0.75 μm thick serpentine nichrome (Ni—Cr) resistive heaters. The resistive heaters were located on top of a 3 μm thick silicon dioxide ($SiO_2$) insulating layer. The outer electrodes of each element were connected to the shape-controllable heating layer through via like structures, as shown in FIG. 1(*c*). Next, a 50 μm hexagonal silicon carbide (6H—SiC) barrier layer was inserted between the heating layer and the top 10 μm-thick $VO_2$ PCM layer. All of the geometrical parameters were optimized using analytical and numerical techniques for the selected antenna structures. The thickness of the $VO_2$ PCM layer was determined by considering two factors—obtaining the maximum heat transition across the PCM layer and transmitting and receiving RF signals efficiently. Electric potential was applied to the electrodes of selected elements allowing the Ni—Cr heating layer to generate heat through Joule heating, which propagated to the PCM layer.

A planar monopole antenna with a coplanar waveguide (CPW) feedline was constructed. It included a radiator plane and two identical and finite ground planes, which were orientated in a different fashion relative to conventional ultra-wideband (UWB) antennas' ground planes. Generally, the bandwidth of microstrip antennas is not wide enough to support multiple resonances frequencies in one antenna pattern. The present invention allows for differences in the position of the ground planes and other antenna components. More precisely, these ground planes can be located on each side of the radiator element to ensure the CPW-feed. In addition, the feeding linewidth (B) was set to 2.05 mm for impedance matching at the operating bandwidth. To realize capacitive coupling between the feed line and each of the ground planes, 0.12 mm spacings (D) were provided, as shown in FIG. 2. These spacings were attained by modifying the microheater elements, at the edges of the ground planes.

FIG. 2 shows a top-view schematic for one antenna pattern that can be produced by embodiments of the present invention. This antenna design is a T-shaped antenna pattern, with a coplanar feed line and two ground planes. For this particular simulated design, the antenna had a $VO_2$ PCM layer with a width (W=18.4 mm) and length (L=18.4 mm), a ground plane length (A=2.025 mm), a gap between the antenna pattern and the ground planes (C=4.1 mm), and a space between the edge of the $VO_2$ layer and the radiation plane (h=2.025 mm). To estimate the antenna parameters, the following equation can be utilized:

$$W = L = \frac{c}{2f\sqrt{\varepsilon_{eff}}} \tag{4}$$

where c is the speed of light, f is the operating frequency, $\in_{eff}$ can be defined as $(\in_r+1)/2$, and $\in_r$ is the dielectric constant of the 6H—SiC barrier layer between the $VO_2$ PCM layer and the matrix configuration. The 6H—SiC barrier layer, in addition to serving as a heat bridge with high thermal conductivity, electrically isolates the antenna pattern induced in the $VO_2$ PCM from the metallic components of the underlying microheater matrix configuration to prevent shorting.

Thermal studies of the proposed antenna platform were performed using commercial finite element method (FEM) software, while characteristics of different antenna configurations were simulated using a commercial electromagnetic (EM) field solver. In the thermal simulations, the generation and transferring of heat was modelled by applying a DC bias to the electrodes. By flowing current through the microheaters, electric energy was converted to heat. Heat transfer in solids and electric currents are coupled through a time-dependent thermal transport equation to monitor temperature changes in the system:

$$dC_P\frac{dT}{dt} - \nabla\cdot(k\nabla T) = -\nabla V\cdot J \tag{5}$$

where d is the mass density, $C_P$ is the heat capacity, T is the temperature, k is the thermal conductivity, V is the applied electrical potential, and J is the current density. To accurately model the electrical and the thermal characteristics of the structure, a mesh with minimum lateral grid size ~0.1 μm was applied. Material related parameters for each layer used in the electro-thermal simulations are presented in Table 1.

TABLE 1

Thermal conductivity, heat capacity and density of the antenna platform.

| | κ (W/m K) | $C_P$ (J/kg K) | d (kg/$m^3$) |
|---|---|---|---|
| Ni—Cr | 15 (Ref. 54) | 20 (Ref. 54) | 9000 (Ref. 54) |
| Ni | 90 (Ref. 54) | 445 (Ref. 54) | 8900 (Ref. 54) |
| $Al_2O_3$ | 35 (Ref. 56) | 729 (Ref. 56) | 3970 (Ref. 56) |
| 6H—SiC | 490 (Ref. 57) | 690 (Ref. 58) | 3216 (Ref. 57) |
| $VO_2$ | 6 (Ref. 59) | 690 (Ref. 19) | 4540 (Ref. 60) |
| $SiO_2$ | 1.1 (Ref. 61) | 8375 (Ref. 61) | 2500 (Ref. 61) |

In the electromagnetic wave propagation analysis, dielectric permittivity ($\in_r$) and electrical conductivity (σ) values used for both states of the $VO_2$ PCM were taken from experimental data.

The temperature distribution plots of two neighboring elements are shown in FIG. 3. A point of interest can be seen in the mid-point between two neighboring elements on the upper surface of the $VO_2$ PCM layer, which must be converted to the metallic phase to obtain the desired antenna configuration. During the heating process, the 6H—SiC barrier layer acts as a heat transfer bridge channeling the generated heat to the $VO_2$ PCM layer due to its high thermal conductivity, relative to the other components of the structure. This reduces the need for obtaining high temperatures in the Ni—Cr heating layer for PCM layer phase transition.

Figures 3A, 3B, 3C, 3D:
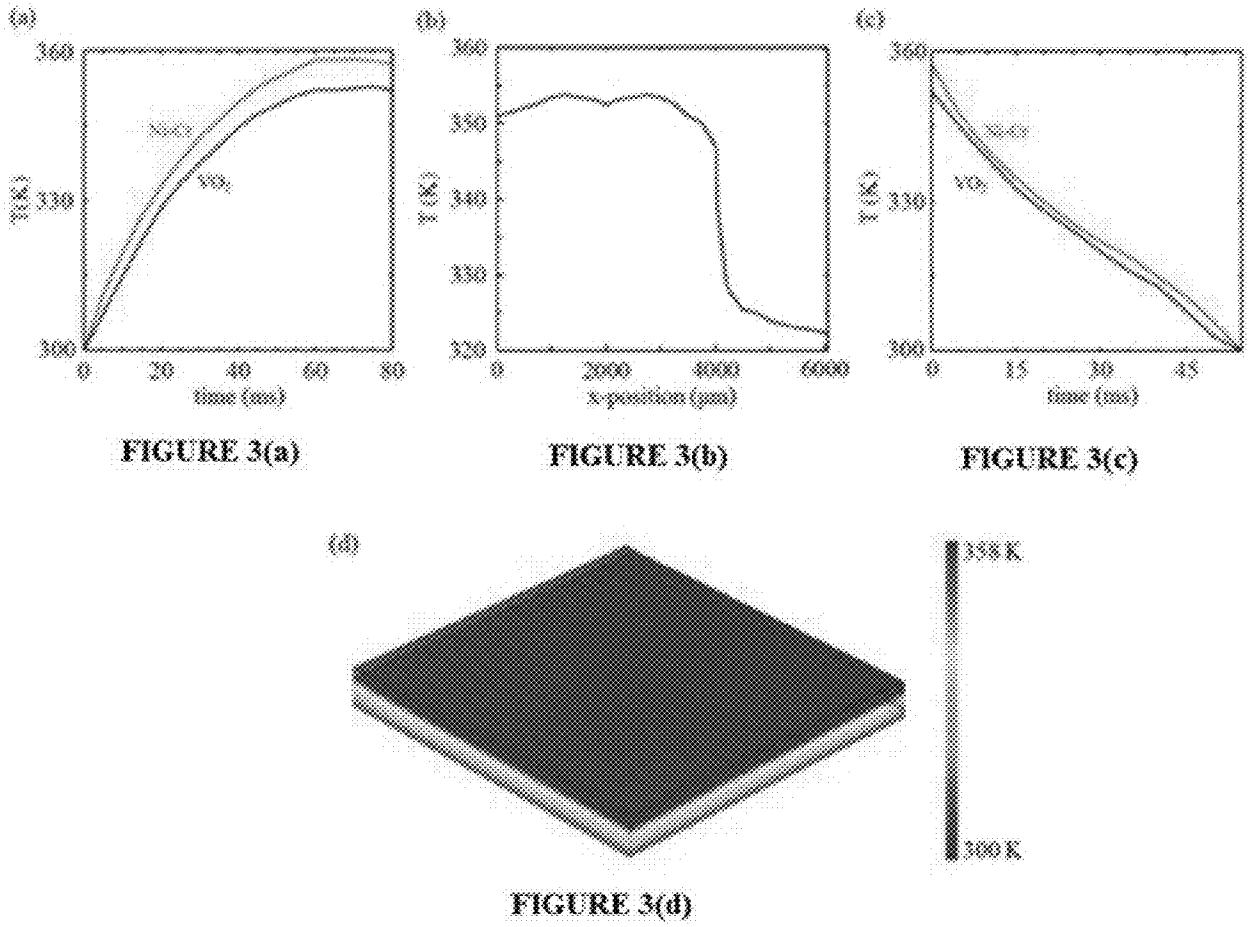
FIG. 3(*a*) is a graph showing time-dependent temperatures at the Ni—Cr heater and between two neighboring elements on the vanadium dioxide ($VO_2$) layer for a heating cycle.
Figure 4A:
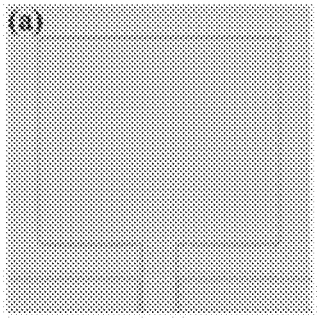
FIGS. 4(*a*), 4(*b*), 4(*c*), 4(*d*), 4(*e*), and 4(*f*) are antenna patterns obtained using phase-change material (PCM) antennas of embodiments of the present invention.
Figure 4B:
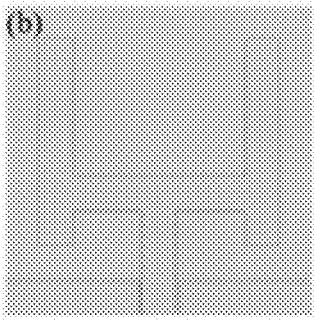
Figure 4C:
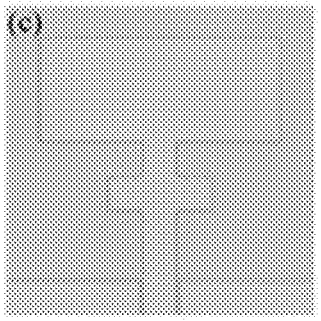
Figure 4D:
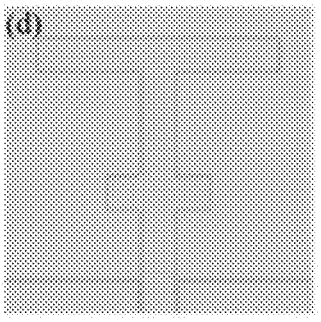
Figure 4E:
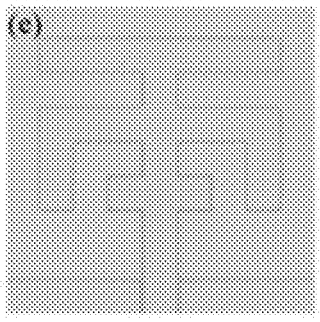
Figure 4F:
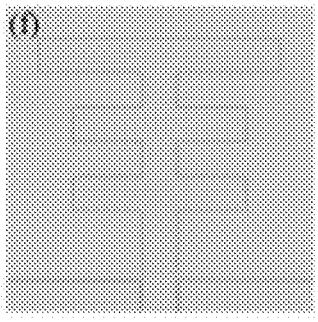

While applying bias to selected elements, the time evolution of the temperature distribution of the antenna structure was monitored. At the beginning, the $VO_2$ PCM was assumed to be in the OFF state, and the temperature at the bottom of the substrate was set to 300 K, which could be realized by thermoelectric cooling, if necessary. By applying an electric pulse (0.08 mA for 60 ms) to the selected Ni electrodes, the Ni—Cr was heated to 358 K, which increased the temperature of the $VO_2$ PCM to initiate the phase transition, as seen in FIG. 3(*a*). The temperature profile on the $VO_2$ layer across three elements, two of which are in the ON state and one of which is in the OFF state, is shown in FIG. 3(*b*). It should be noted that the temperature on the surface of the $VO_2$ layer was extremely uniform with only a 3 Celsius variation, as seen in FIG. 3*d*.

It can be seen that the temperature abruptly drops at the edge of the active heating element to a lower temperature at which the $VO_2$ has very high resistivity. The generated antenna pattern is preserved as long as the power compensating the heat dissipation to the ambient is provided to keep the temperature of the critical point above the insulator-to-metal transition temperature of the $VO_2$ PCM. To maintain this thermal balance and keep the temperature of the selected element constant, the applied bias can be reduced (e.g., to 0.075 mA) because less energy is needed to keep the PCM temperature constant as opposed to raising the temperature.

Once the DC bias was removed (cooling cycle), the temperature of the PCM dropped back to 300 K in 55 ms (FIG. 3(*c*)). It should be noted that, even with the most severe hysteresis cases, $VO_2$ loses its metallic phase at ~315 K in a cooling cycle. Hence, a new antenna pattern can be generated in as soon as 35 ms. Thermal crosstalk due to lateral heating between the Ni electrodes, which causes a modest temperature change (~30 K) under the Ni—Cr heater section, was also taken into account.

By following the indirect heating procedure, the required $T_C$ for the phase transition of the selected $VO_2$ regions (i.e. CPW-feed, radiator and ground patterns) was achieved. After completing this process, the metallic regions of the $VO_2$ layer can be employed as an antenna to transmit and receive high frequency EM signals with low transmission losses. The remaining $VO_2$ PCM regions act as highly resistive (or dielectric) material since they do not exceed the critical phase transition temperature.

Several antenna patterns were designed to work at different frequency bands. The corresponding return loss ($|S_{11}|$), voltage standing wave ratio (VSWR) and far-field radiation patterns of the proposed antenna patterns were investigated using numerical analysis. The $|S_{11}|$ characteristics showed pronounced resonant frequencies to operate in the S, C, and X-bands, proving the versatility of the present invention. The following structures show how antenna platforms of the present invention can create antenna structures for different applications. It should be noted that the present invention can be applied with reduced size and an increased number of elements to obtain higher resolution antenna structure configurations, providing enhanced and application specific performance.

Figure 5A:
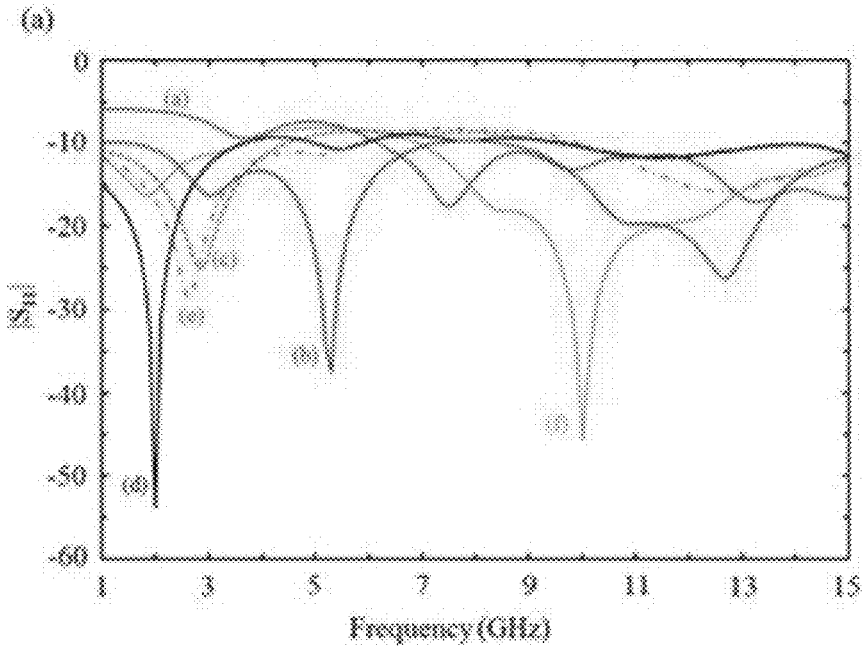
FIG. 5(*a*) is a graph of calculated $|S_{11}|$ parameters, and FIG. 5(*b*) is a graph of calculated voltage standing wave ratio (VSWR) versus frequency for the various antenna structures shown in FIG. 4.
Figure 5B:
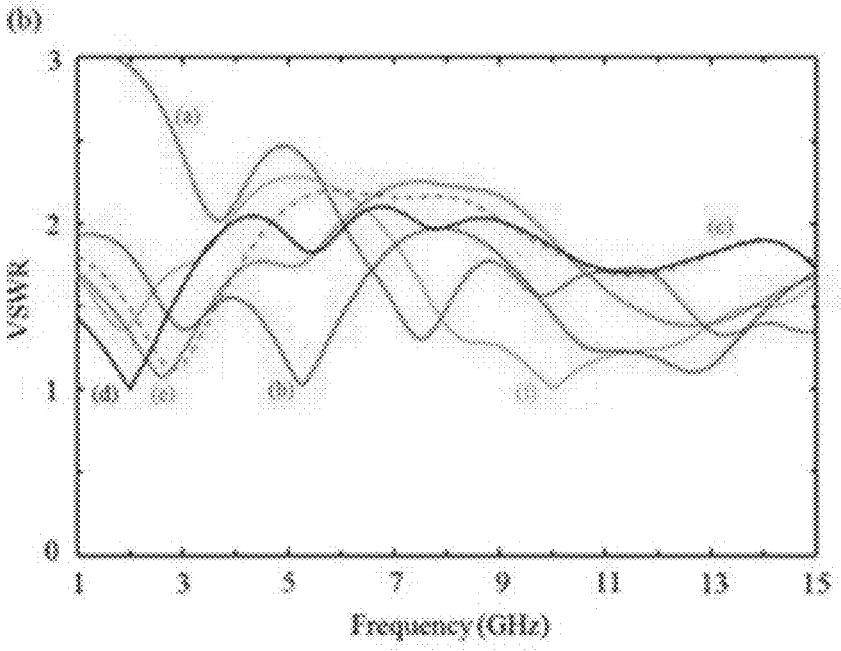

The antenna structures shown in FIGS. 4(*a*) and 4(*b*) are designed for the C-band spectrum. The antenna patterns in FIGS. 4(*c*), 4(*d*), and 4(*e*) are designed to operate in the S-band, while the last pattern in FIG. 4(*f*) is designed to operate in the X-band. The $|S_{11}|$ parameters of the proposed antenna structures with and without the recesses are demonstrated in FIG. 5(*a*). During the geometrical variations from antenna "a" to "b", "c", "d", "e" and "f", notable resonance shifts were observed from 7.4 GHz to 5.2 GHz, 2.8 GHz, 2 GHz, 2.7 GHz, and 10 GHz, respectively.

Antenna performance could substantially be improved with different patterns. The antenna "a" pattern presented the lowest impedance matching in the operating frequency band. Inclusion of the specific recesses enhances its impedance matching performance in patterns "b", "f", and "d," where "d" provided the best transmission behavior relative to the other designs. Hence, operating frequencies of the antenna platform can be controlled to switch between different bands by actively altering the heating pattern. The demonstrated frequency range covered the UWB range (3.1-10.6 GHz), with high quality gain values.

The simulated far-field radiation patterns in the xz plane (E-plane) of the investigated antennas are shown for frequencies of 7.4 GHz, 5.2 GHz, 2.8 GHz, 2 GHz, 2.7 GHz, and 10 GHz, respectively, in FIG. 6. These results indicate that antenna "a" radiates quasi bidirectional and dipolar-type radiation patterns. With the help of recesses introduced to antenna "a", radiation patterns lose their bidirectional property (see FIGS. 6*b*, 6*c*, 6*d*, 6*e* and 6*f*), and become more unidirectional toward the z-direction. In addition, it is observed that these far-field radiation patterns are smooth for the covered frequencies and stable along the entire operating band.

Example 2

Summarizing a potential best mode, an embodiment of the present invention can include a $VO_2$-based reconfigurable planar antenna platform with a microheater matrix that controls antenna pattern shape. The antenna platform can quickly generate any antenna pattern by changing the phase of the selected $VO_2$ regions between metallic and dielectric phases through thermal stimuli. The heat for the indirect thermal stimulation can be generated by joule heating in an Ni—Cr resistive layer and transferred to the $VO_2$ layer through a silicon carbide (SiC) spacer layer with high thermal conductivity. The antennas can efficiently operate at S, C, and X-bands and cover the entire UWB range for future generation radio technologies. The proposed platform can be used in various reconfigurable antenna and circuit applications, including but not limited to low-energy, high-bandwidth communications, non-cooperative radar imaging, target sensor data collection, as well as precision locating and tracking.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein (including those in the "References" section) are incorporated by reference in their entirety, including all figures and tables, to the extent they are not inconsistent with the explicit teachings of this specification.

REFERENCES

1. L. Huitema et al. Highly integrated VO2-based antenna for frequency tunability at millimeter-wave frequencies, International Workshop on Antenna Technology (iWAT), IEEE (2016).
2. M. Wang et al. An X-band reconfigurable bandpass filter using phase change RF switches, IEEE topical meetings on Silicon Monolithic Integrated Circuits in RF Systems, 38-41 (2016).
3. T. S. Teeslink et al. Reconfigurable bowtie antenna using metal-insulator transition in vanadium dioxide, IEEE Antennas Wireless Propag. Lett. 14, 1381-1384 (2015).
4. S. D. Ha et al. Quick switch: strongly correlated electronic phase transition systems for cutting-edge microwave devices, IEEE Microwave Mag. 15, 32-44 (2014).
5. Y. Shim et al. RF-switches using phase change materials, IEEE 26th Int. Conf. MEMS, 237-240 (2013).
6. N. El-Hinnawy et al. A four-terminal, inline, chalcogenide phase-change RF switch using an independent resistive heater for thermal actuation, IEEE Electron Devices Lett. 34, 1313-1315 (2013).

7. F. Dumas-Bouchiat et al. RF-Microwave switches based on reversible semiconductor-metal transition of VO2 thin films synthesized by pulsed-laser deposition, Appl. Phys. Lett. 91, 223505 (2007).
8. C. W. Manry, Jr., et al. Configurable antenna assembly, US Patents, US20150295309 A1, 2015.
9. D. Cheng et al. Reconfigurable patch antenna apparatus, systems, and methods, US Patents, U.S. Pat. No. 7,403, 172 B2, 2008.
10. E. K. Walton et al. Reconfigurable antenna using addressable element pistons, US Patents, US20080198074 A1, 2008.
11. T. N. Jackson et al. Actively reconfigurable elementized antenna systems, US Patents, U.S. Pat. No. 6,885,345 B2, 2005.
12. G. C. Taylor et al. Reconfigurable antenna, US Patents, U.S. Pat. No. 6,567,046 B2, 2003.
13. F. J. Morin, *Phys. Rev. Lett.* 1959, 3, 34.
14. J. Dai, X. Wang, Y. Huang, X. Yi, *Opt. Eng.* 2008, 47, 033801.
15. A. Zylbersztejn, N. F. Mott, *Phys. Rev. B* 1975, 11, 4383.
16. G. Stefanovich, A. Pergament, D. Stefanovich, *J. Phys.: Condens. Matter.* 2000, 12, 8837.
17. E. Strelcov, Y. Lilach, A. Kolmakov, *Nano Lett.* 2009, 9, 2322-2326.
18. M. M. Qazilbash, M. Brehm, B. G. Chae, P. C. Ho, G. O. Andreev, B. J. Kim, S. J. Yun, A. V. Balatsky, M. B. Maple, F. Keilmann, H. T. Kim, D. N. Basov, *Science* 2007, 318, 1750.
19. V. Eyert, *Ann. Phys.* 2002, 11, 650.
20. H. T. Kim, B. G. Chae, D. H. Youn, S. L. Maeng, G. Kim, K. Y. Kang, Y. S. Lim, *New J. Phys.* 2004, 6, 52.
21. M. Calatayud, B. Silvi, J. Andres, A. Beltran, *Chem. Phys. Lett.* 2001, 333, 493.
22. R. M. Wentzcovitch, W. W. Schulz, P. B. Allen, *Phys. Rev. Lett.* 1994, 72, 3389.
23. A. Cavelleri, Cs. Tóth, C. W. Siders, J. A. Squier, F. Raksi, P. Forget, J. C. Kieffer, *Phys. Rev. Lett.* 2001, 87, 237401.
24. H. Coy, R. Cabrera, N. Sepúlveda, F. E. Fernández, *J. Appl. Phys.* 2010, 108, 113115.
25. E. Merced, N. Dávila, D. Tones, R. Cabrera, F. E. Fernández, N. Sepúlveda, *Smart Mater. Struct.* 2012, 21, 105009.
26. G. Bakan, B. Gerislioglu, F. Dirisaglik, Z. Jurado, L. Sullivan, A. Dana, C. Lam, A. Gokirmak, H. Silva, *J. Appl. Phys.* 2016, 120, 164504.
27. M. Wang, F. Lin, M. Rais-Zadeh, *IEEE topical meetings on Silicon Monolithic Integrated Circuits in RF Systems* 2016, 38.
28. R. Cabrera, E. Merced, N. Sepúlveda, *IEEE/ASME J. Microelectromech. Syst.* 2014, 23, 243.
29. F. Dumas-Bouchiat, C. Champeaux, A. Catherinot, A. Crunteanu, P. Blondy, *Appl. Phys. Lett.* 2007, 91, 223505.
30. P. U. Jepsen, B. M. Fischer, A. Thoman, H. Helm, J. Y. Suh, R. Lopez, R. F. Jr. Haglund, *Phys. Rev. B.* 2006, 74, 205103.
31. J. O. Miranda, Y. Ezzahri, J. Drevillon, K. Joulain, *J. Appl. Phys.* 2016, 119, 203105.
32. A. Ahmadivand, B. Gerislioglu, R. Sinha, M. Karabiyik, N. Pala, *Sci. Rep.* 2017, 7, 42807.
33. M. Seo, J. Kyoung, H. Park, S. Koo, H. S. Kim, H. Bernien, B. J. Kim, J. H. Choe, Y. H. Ahn, H. T. Kim, N. Park, Q. H. Park, K. Ahn, D. S. Kim, *Nano Lett.* 2010, 10, 2064.
34. M. Jusoh, T. Aboufoul, T. Sabapathy, A. Alomainy, M. R. Kamarudin, *IEEE Antennas Wireless Propag. Lett.* 2014, 13, 79.
35. D. E. Anagnostou, A. Gheethan. *IEEE Antennas Wireless Propag. Lett.* 2009, 8, 1057.
36. D. Peroulis, K. Sarabandi, L. P. B. Katehi, *IEEE Trans. Antennas Propag.* 2005, 53, 645.
37. J. T. Bernhard, R. Wang, R. Clark, P. Mayes, *IEEE Antennas and Propag. Society Symp. Dig.* 2001, 158.
38. N. Romano, G. Prisco, F. Soldovieri, *Progress In Electromagnetics Research* 2009, 94, 1.
39. U. R. Pfeiffer, Y. Zhao, J. Grzyb, R. A. Hadi, N. Sarmah, W. Förster, H. Rücker, B. Heinemann, *IEEE Int. Solid-State Circuits Conf.* 2014, 256.
40. H. F. Abutarboush, R. Nilavalan, S. W. Cheung, K. M. Nasr, T. Peter, D. Budimir, H. Al-Raweshidy, *IEEE Trans. Antennas Propag.* 2012, 60, 36.
41. C. Lugo, J. Papapolymerou, *IEEE Trans. Antennas Propag.* 2006, 54, 479.
42. S. Nikolaou, R. Bairavasubramanian, C. Lugo, I. Carrasquillo, D. C. Thompson, G. E. Ponchak, J. Papapolymerou, M. M. Tentzeris, *IEEE Trans. Antennas Propag.* 2006, 54, 439.
43. N. Behdad, K. Sarabandi, *IEEE Trans. Antennas Propag., Special Issue on Multifunction Antennas and Antenna Systems,* 2006, 54, 401.
44. B. A. Cetiner, H. Jafarkhani, J. Y. Qian, H. J. Yoo, A. Grau, F. D. Flaviis, *IEEE Commun. Mag.* 2004, 42, 62.
45. T. S. Teeslink, D. Tones, J. L. Ebel, N. Sepulveda, D. E. Anagnostou, *IEEE Antennas Wireless Propag. Lett.* 2015, 14, 1381.
46. D. E. Anagnostou, M. T. Chryssomallis, B. D. Braaten, J. L. Ebel, N. Sepúlveda, *IEEE Trans. Antennas Propag.* 2014, 62, 602.
47. L. Huitema, A. Crunteanu, H. Wong, *International Workshop on Antenna Technology* (*iWAT*), *IEEE* 2016.
48. Y. Shim, G. Hummel, M. Rais-Zadeh, *IEEE* 26$^{th}$ *Int. Conf. MEMS* 2013, 237.
49. A. Sebastian, M. Le Gallo, D. Krebs, *Nat. Commun.* 2014, 5, 4314.
50. F. Dirisaglik, G. Bakan, Z. Jurado, S. Muneer, M. Akbulut, J. Rarey, L. Sullivan, M. Wennberg, A. King, L. Zhang, R. Nowak, C. Lam, H. Silva, A. Gokirmak, *Nanoscale* 2015, 7, 16625.
51. K. Shportko, S. Kremers, M. Woda, D. Lencer, J. Robertson, M. Wuttig, *Nat. Mater.* 2008, 7, 653.
52. A. Faraclas, G. Bakan, L. Adnane, F. Dirisaglik, N. E. Williams, A. Gokirmak, H. Silva, *IEEE Trans. Electron Devices* 2014, 61, 372.
53. N. Yamada, E. Ohno, K. Nishiuchi, N. Akahira, M. Takao, *J. Appl. Phys.* 1991, 69, 2849.
54. N. El-Hinnawy, P. Borodulin, B. Wagner, M. R. King, J. S. Mason Jr., E. B. Jones, S. McLaughlin, V. Veliadis, M. Snook, M. E. Sherwin, R. S. Howell, R. M. Young, M. J. Lee, *IEEE Electron Devices Lett.* 2013, 34, 1313.
55. S. Raoux, H. Y. Cheng, M. A. Caldwell, H. S. P. Wong, *Appl. Phys. Lett.* 2009, 95, 071910.
56. S. D. Ha, Y. Zhou, A. E. Duwel, D. W. White, S. Ramanathan, *IEEE Microwave Mag.* 2014, 15, 32.
57. O. A Mashaal, S. K. A. Rahim, A. Y. Abdulrahman, M. I. Sabran, M. S. A Rani, P. S. Hall, *IEEE Trans. Antennas Propag.* 2013, 61, 939.
58. FCC, Washington, D.C., First Rep. Order 2002, 48.
59. S. Nikolaou, M. A. B. Abbasi, *IEEE Trans. Antennas Propag.* 2017.
60. G. Wang, Q. Feng, *IEEE Antennas Wireless Propag. Lett.* 2014, 13, 774.

61. C. Canhui, E. Yung, *IEEE Trans. Antennas Propag.* 2009, 57, 1829.
62. W. Chien-Jen, H. De-Fu, *IEEE Antennas Wireless Propag. Lett.* 2004, 3, 186.
63. T. M. Weller, L. P. B. Katehi, G. M. Rebeiz, *IEEE Trans. Antennas Propag.* 1995, 43, 1423.
64. H. D. Chen, H. T. Chen, *IEEE Trans. Antennas Propag.* 2004, 52, 978.
65. H. W. Liu, C. H. Ku, C. F. Yang, *IEEE Antennas Wireless Propag. Lett.* 2010, 9, 240.
66. COMSOL Multiphysics 5.2, COMSOL, Inc.
67. Ansys HFSS 13.0, ANSYS, Inc.
68. P. Auerkari, *Finland: Technical Research Centre of Finland* 1996.
69. E. A. Burgemesiter, W. Vonmuench, E. Pettenpaul, *J. Appl. Phys.* 1979, 50, 5790.
70. L. Hitova, R. Yakimova, E. P. Trifonova, A. Lenchev, E. Janzen, *J. Electrochem. Soc.* 2000, 147, 3546.
71. D. W. Oh, C. Ko, S. Ramanathan, D. G. Cahill, *Appl. Phys. Lett.* 2010, 96, 151906.
72. E. Freeman, A. Kar, N. Shukla, R. Misra, R. Engel-Herbert, D. Schlom, V. Gopalan, K. Rabe, S. Datta, *Device Research Conference* (*DRC*) 2012.
73. R. M. Young, N. El-Hinnawy, P. Borodulin, B. P. Wagner, M. R. King, E. B. Jones, R. S. Howell, M. J. Lee, *J. Appl. Phys.* 2014, 116, 054504.
74. D. C. Giancoli, *Prentice Hall* 1995
75. V. S. Kiiko, V. Y. Vaispapir, *Glass Ceram* 2015, 71, 387.
76. K. K. Kelley, Washington, US: Bulletin 1960, 584.
77. J. Y. Siddiqui, C. Saha, Y. M. M. Antar, *IEEE Trans. Antennas Propag.* 2014, 62, 4015.
78. J. Y. Siddiqui, C. Saha, Y. M. M. Antar, *IEEE Antennas Wireless Propag. Lett.* 2015, 14, 100.
79. R. Zaker, A. Abdipour, *IEEE Antennas Wireless Propag. Lett.* 2010, 9, 471.
80. R. Azim, M. T. Islam, N. Misran, S. W. Cheung, Y. Yamada, *Microwave Opt. Technol. Lett.* 2011, 53, 966.
81. R. Zaker, C. Ghobadi, A. Abdipour, *IEEE Antennas Wireless Propag. Lett.* 2008, 7, 112.

What is claimed is:

1. A reconfigurable antenna platform comprising:

a phase change material (PCM) layer that is conductive in a first phase and insulating in a second phase; and a shape-controllable heating layer beneath the PCM layer and configured to provide heat to the PCM layer such that the first phase or the second phase changes, the shape-controllable heating layer including a microheater array, and the PCM layer including an antenna pattern having a feed line and a ground plane.

2. The antenna platform of claim 1, the microheater array being a minimum of six microheater wide and six microheater long.

3. The antenna platform of claim 1, the microheaters being nickel-chromium heaters.

4. The antenna platform of claim 1, the PCM layer including vanadium dioxide ($VO_2$).

5. The antenna platform of claim 1, the antenna platform operating in a frequency range of from 2.0 GHz to 10 GHz, inclusive.

6. The antenna platform of claim 1, the PCM layer including germanium antimony telluride or germanium telluride.

7. The antenna platform of claim 1, further comprising a barrier layer between the shape-controllable heating layer and the PCM layer.

8. The antenna platform of claim 1, further comprising an insulating layer beneath the shape-controllable heating layer.

9. The antenna platform of claim 1, each microheater of the microheater array including a serpentine heating element.

10. The antenna platform of claim 1, a thickness of the PCM layer being less than or equal to 30 μm.

11. The antenna platform of claim 1, the antenna platform having a length of 2.0 centimeters (cm) or less and a width of 2.0 cm or less.

12. The antenna platform of claim 1, the antenna platform being capable of forming a new antenna structure in 200 milliseconds or less.

13. A reconfigurable antenna platform comprising:

a phase change material (PCM) layer that is conductive in a first phase and insulating in a second phase;

a shape-controllable heating layer beneath the PCM layer and configured to provide heat to the PCM layer such that the first phase or the second phase changes, the shape-controllable heating layer including a microheater array that is a minimum of six elements wide and six elements long;

a barrier layer between the shape-controllable heating layer and the PCM layer; and an insulating layer beneath the shape-controllable heating layer, the PCM layer including an antenna pattern having a feed line and a ground plane.

14. The antenna platform of claim 13, the microheaters being nickel-chromium heaters.

15. The antenna platform of claim 13, the PCM layer including vanadium dioxide ($VO_2$).

16. The antenna platform of claim 13, the antenna platform operating in S-, C-, and X-frequency bands.

17. The antenna platform claim of 13, the PCM layer including germanium antimony telluride or germanium telluride.

18. The antenna platform of claim 13, further comprising an electrode layer beneath the insulating layer and connected to the shape-controllable heating layer through vias in the insulating layer.

19. A reconfigurable antenna platform comprising:

a phase change material (PCM) layer including vanadium dioxide (VO2) that is conductive in a first phase and insulating in a second phase, the phase PCM material layer having a thickness less than or equal to 30 μm;

a shape-controllable heating layer beneath the PCM layer and configured to provide heat to the PCM layer such that the first phase or the second phase changes, the shape-controllable heating layer including a microheater array that is a minimum of six elements wide and six elements long, each microheater having a serpentine heating element;

a barrier layer between the shape-controllable heating layer and the PCM layer;

an insulating layer beneath the shape-controllable heating layer;

an electrode layer beneath the insulating layer and connected to the shape-controllable heating layer through vias in the insulating layer; and a protective layer covering the PCM layer.

* * * * *